US011745939B2

(12) United States Patent
Brown

(10) Patent No.: US 11,745,939 B2
(45) Date of Patent: Sep. 5, 2023

(54) MOISTURE PREVENTION PACKAGING METHOD

(71) Applicant: Crown Products & Services, Inc., Gillette, WY (US)

(72) Inventor: Arthur B. Brown, Durango, CO (US)

(73) Assignee: Crown Products & Services, Inc., Gillette, WY (US)

( * ) Notice: Subject to any disclaimer, the term of this patent is extended or adjusted under 35 U.S.C. 154(b) by 7 days.

(21) Appl. No.: 17/534,003

(22) Filed: Nov. 23, 2021

(65) Prior Publication Data

US 2022/0081201 A1 Mar. 17, 2022

Related U.S. Application Data

(62) Division of application No. 16/411,675, filed on May 14, 2019, now Pat. No. 11,220,399.

(60) Provisional application No. 62/671,237, filed on May 14, 2018.

(51) Int. Cl.

| | |
|---|---|
| ***B65B 53/02*** | (2006.01) |
| ***B65D 88/16*** | (2006.01) |
| ***B65D 90/22*** | (2006.01) |
| ***B65D 19/00*** | (2006.01) |
| ***B65D 77/04*** | (2006.01) |
| ***B65D 75/00*** | (2006.01) |

(Continued)

(52) U.S. Cl.

CPC ..... *B65D 88/1612* (2013.01); *B65B 53/02* (2013.01); *B65B 53/06* (2013.01); *B65B 55/00* (2013.01); *B65D 19/0008* (2013.01); *B65D 75/002* (2013.01); *B65D 77/04* (2013.01); *B65D 90/22* (2013.01); *B65B 2220/20* (2013.01); *B65D 2519/0086* (2013.01); *B65D 2588/165* (2013.01)

(58) Field of Classification Search

CPC ..... B65B 9/135; B65B 53/00; B65B 53/02; B65B 53/06; B65B 55/00; B65B 2220/20; B65D 75/002; B65D 77/04; B65D 88/1612; B65D 2571/00067; B65D 2588/165

USPC ..... 53/442, 449, 173, 557

See application file for complete search history.

(56) References Cited

U.S. PATENT DOCUMENTS 3,522,688 A * 8/1970 Kaliwoda et al. ..... B65B 53/06 53/442
4,434,603 A * 3/1984 Beumer ..... B65B 53/066 53/557

(Continued)

FOREIGN PATENT DOCUMENTS

DE 20303637 U1 * 8/2003 ..... B65D 19/38
FR 2844778 A1 * 3/2004 ..... B65D 2588/165

*Primary Examiner* — Stephen F. Gerrity

(74) *Attorney, Agent, or Firm* — Reinhart Boerner Van Deuren s.c.

(57) ABSTRACT

A packaged article is composed of a bulk bag having a top end and a bottom end. Further included is a pallet having a first side and a second side. Also included are an outer bag having a first closed end and a first open end and a heatshrink bag having a second closed end and a second open end. The first closed end of the outer bag is between the bottom end of the bulk bag and the first side of the pallet. The first open end of the outer bag is gathered over the top end of the bulk bag to enclose the bulk bag within the outer bag. The second closed end of the heatshrink bag is proximate to the top end of the bulk bag and the second open end contacts the second side of the pallet.

8 Claims, 9 Drawing Sheets

(51) Int. Cl.
*B65B 55/00* (2006.01)
*B65B 53/06* (2006.01)

(56) References Cited

U.S. PATENT DOCUMENTS

| | | | | |
|---|---|---|---|---|
| 5,018,877 | A * | 5/1991 | Kantz | B65D 77/061 141/93 |
| 5,353,936 | A | 10/1994 | Dockstader et al. | |
| 5,653,354 | A | 8/1997 | Olson | |
| 5,791,123 | A * | 8/1998 | Bolz | B65B 31/024 53/449 |
| 6,012,266 | A * | 1/2000 | Koskinen et al. | B65D 71/0096 53/442 |
| 7,284,360 | B2 * | 10/2007 | Cary et al. | B65B 53/02 53/449 |
| 2010/0071317 | A1 * | 3/2010 | Michels et al. | B65B 9/135 53/441 |
| 2014/0126844 | A1 | 5/2014 | Lowry et al. | |
| 2015/0239637 | A1 * | 8/2015 | Kranz | B65D 77/04 206/204 |
| 2017/0175596 | A1 | 6/2017 | Ikemi et al. | |

* cited by examiner

MOISTURE PREVENTION PACKAGING METHOD

CROSS REFERENCE TO RELATED PATENT APPLICATIONS

This application is a divisional of U.S. application Ser. No. 16/411,675, filed May 14, 2019, which claims the benefit of priority to U.S. Provisional Application No. 62/671,237, filed May 14, 2018, which is incorporated herein by reference in its entireties.

BACKGROUND

The disclosure relates generally to packaging and more particularly to a packaged article and to a packaging method that substantially prevents moisture penetration.

SUMMARY

According to one aspect, embodiments of a packaged article are provided. The packaged article is composed of a bulk bag having a top end and a bottom end and containing a material. The packaged article also includes a pallet having a first side and a second side in which the second side is opposite the first side. Further, the packaged article includes an outer bag having a first closed end and a first open end and a heatshrink bag having a second closed end and a second open end. The bulk bag is positioned in the outer bag such that the first closed end of the outer bag is between the bottom end of the bulk bag and the first side of the pallet. Further, the first open end of the outer bag is gathered over the top end of the bulk bag to enclose the bulk bag within the outer bag. Additionally, the heatshrink bag is positioned such that the second closed end is proximate to the top end of the bulk bag and such that the second open end contacts at least a portion of the second side of the pallet.

In another aspect, embodiments of a packaged article are provided. The packaged article includes a bulk bag having a top end and a bottom end. The bulk bag contains a dry mix of bed ash and cement in which the weight ratio of bed ash to cement is from 3:1 to 5:1. The packaged article also includes a pallet having a first side and a second side in which the second side being opposite the first side. Also included are an outer bag having a first closed end and a first open end and a heatshrink bag having a second closed end and a second open end. The bulk bag is positioned in the outer bag such that the first closed end of the outer bag is between the bottom end of the bulk bag and the first side of the pallet. The first open end of the outer bag is gathered over the top end of the bulk bag to enclose the bulk bag within the outer bag. Additionally, the heatshrink bag is positioned such that the second closed end is proximate to the top end of the bulk bag and such that the second open end contacts at least a portion of the second side of the pallet.

In still another aspect, embodiments of a method of packaging a bulk bag containing a material are provided. In the method, the bulk bag is inserted inside an outer bag. The bulk bag inside the outer bag is positioned on a pallet. The bulk bag is enclosed inside the outer bag. The pallet on which the bulk bag and the outer bag are positioned is placed on an elevated surface. The bulk bag, the outer bag, and at least a portion of the pallet are covered with a heatshrink bag, and heat is applied to the heatshrink bag so as to cause shrinkage of the heatshrink bag around the bulk bag, the outer bag, and at least a portion of the pallet.

While the invention will be described in connection with certain embodiments, there is no intent to limit it to those embodiments. On the contrary, the intent is to cover all alternatives, modifications and equivalents as included within the spirit and scope of the invention as defined by the appended claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Generally, in this disclosure, various embodiments of a packaged article and method of packaging are provided. The packaging of the packaged article is configured to substantially prevent moisture from reaching the contents on the interior of the packaging. In particular, the packaging is especially suitable for protecting moisture from being absorbed by hydratable or water-reactive materials, such as cements, ashes, and/or other pozzolanic materials. In general, the method of packaging involves placing a bulk bag of such materials into an outer bag, securing the top of the outer bag, and applying a heatshrink bag over the top of the outer bag. Applicant has determined that packaging constructed in accordance with the method disclosed herein is resistant to penetration of ambient water (e.g., humidity, precipitation, and the like) for extended periods of time. In this way, the packaging prevents the contents of the bulk bag from prematurely reacting with or absorbing water during periods of storage. The following exemplary embodiments of the system and method are provided for the purpose of illustration and should not be viewed as limiting.

As used herein, a "bulk bag" refers to a large bag designed to carry bulk materials, especially dry bulk materials. In embodiments, the bulk bag may be made from a woven material. Further, in embodiment, the bulk bag may be made from one or more materials, such as polyester and/or nylon. Bulk bags typically range in size from 28"×28"×12" to 51"×51"×71" and can hold loads of up to 4000 lbs. Often, bulk bags have one or more loops or sleeves that can be attached to the forks of a forklift or to a crane hoist line so that the bulk bag may be lifted and transported. A bulk bag may also be referred to as a flexible intermediate bulk container (FIBC).

As used herein, "heatshrink" refers to the property of a material that causes it to shrink when heat is applied. Heatshrink materials generally are formed from a polymeric film that has been stretched while warm to orient the polymeric macromolecules. Cooling the film sets the orientation of the macromolecules until it is reheated, causing the film to shrink back to the film's original dimensions. When a heatshrink material is placed over an object, the heatshrink material will shrink tightly over or around that object. A "heatshrink bag," thus, refers to a bag having the property of shrinking when exposed to heat (e.g., heat sufficient to raise the temperature of the heatshrink material to a temperature range of about 225° F. to about 375° F.) so as to tightly engage the object around which the heatshrink bag is placed.

Figure 1:
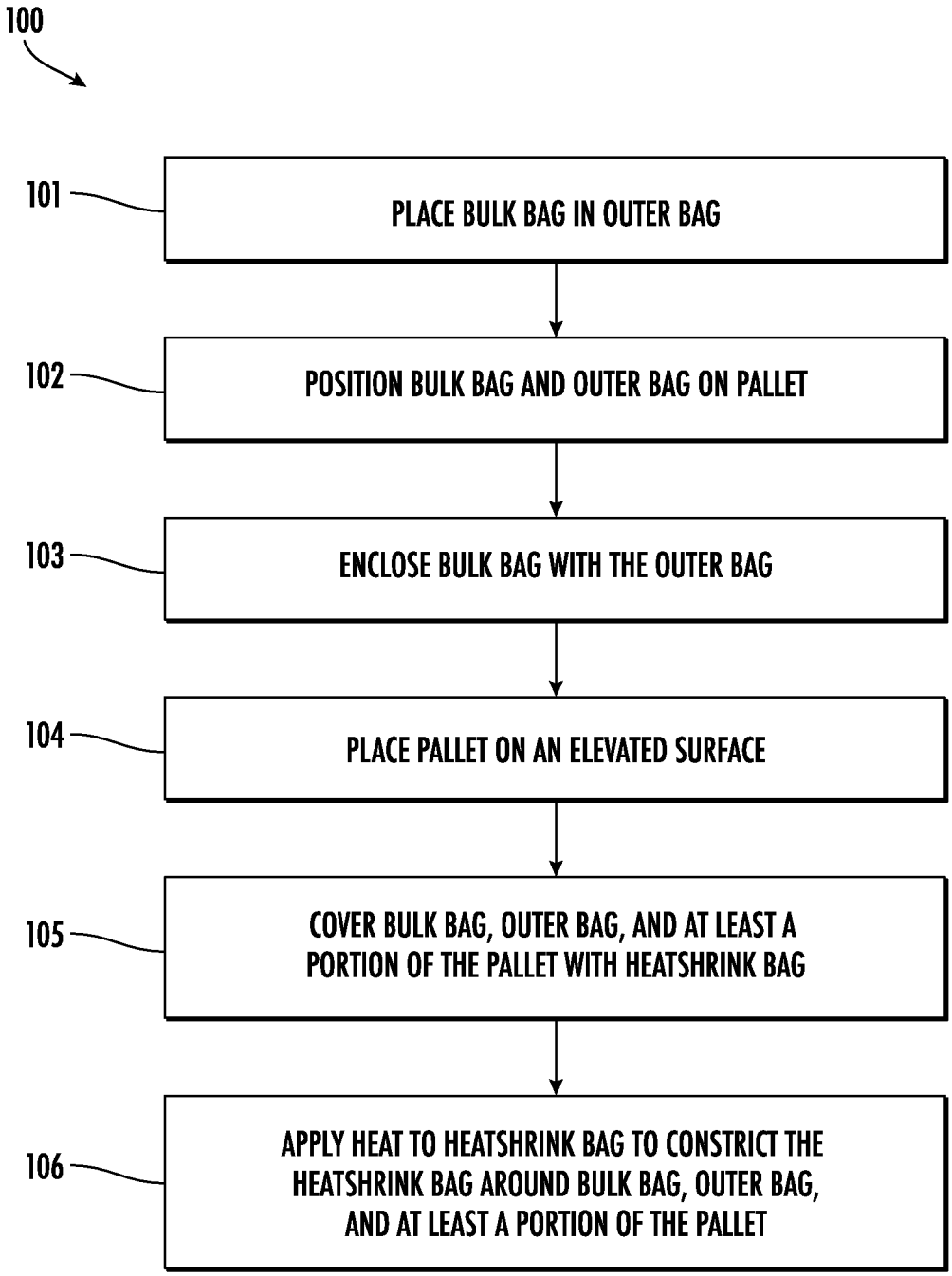
FIG. 1 is a flow diagram of a packaging method, according to an exemplary embodiment.

FIG. 1 provides a flow-diagram of an embodiment of a packaging method 100. Briefly, the method involves a first step 101 of placing a bulk bag in an outer bag. Then, in a second step 102, the bulk bag inside the outer bag is placed on a pallet, and in a third step 103, the outer bag is cinched or otherwise secured around the bulk bag so that the outer bag completely encloses the bulk bag. In a fourth step 104, the pallet is placed on an elevated surface so that, in a fifth step 105, a heatshrink bag can be placed around the bulk bag, the outer bag, and at least a portion of the pallet. A sixth step 106 involves applying heat to the heatshrink bag to constrict the heatshrink bag around the bulk bag, the outer bag, and at least a portion of the pallet.

Packaging an object in this fashion prevents moisture from penetrating to the contents of the bulk bag. Indeed, in practice, such bulk bags may be stored outdoor or in sheds that are not sealed from ambient moisture. As such, the risk of exposure of the contents to ambient moisture is high, and absorption of moisture by the bulk material may degrade the performance of the bulk material when later used, especially where that bulk material's performance depends on its ability to absorb water, such as cements, ashes, and other pozzolanics.

Figure 2:
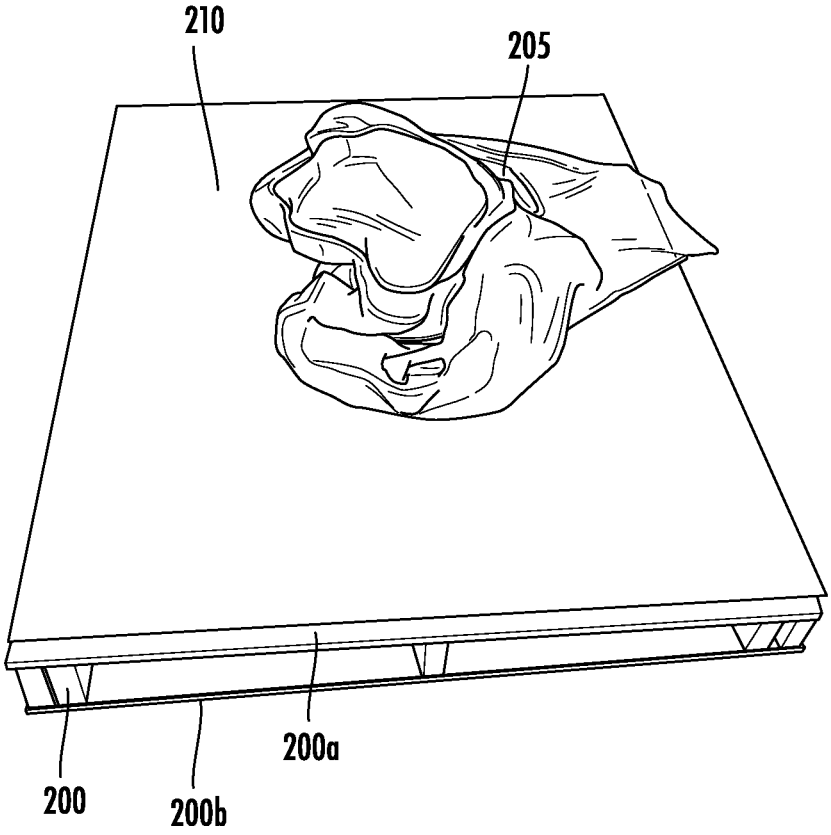
FIG. 2 depicts a pallet that supports a packaged bulk bag, according to an exemplary embodiment.

Having briefly described the packaging method, each step of the method will be described in greater detail with respect to FIGS. 2-9. Turning first to FIG. 2, a pallet 200 and an outer bag 205 are depicted. The pallet 200 has a first side 200*a* and a second side 200*b* that is opposite the first side 200*a*. In the embodiment depicted, a cardboard sheet 210 is provided on the first side 200*a* of the pallet 200 to provide a flat surface on which the bulk bag 215 (shown in FIG. 3) is supported. Additionally, in embodiments, the cardboard sheet 210 provides a layer between the pallet 200 and the outer bag 205 and bulk bag 215 to protect the outer bag 205 and bulk bag 215 from punctures resulting from splinters, which may be present on the pallet 200, especially wooden pallets 200. As pictured in FIG. 3, the bulk bag 215 is full of a bulk material and is being lifted by the forks 220 of a forklift 225. To facilitate lifting and transporting of the bulk bag 215, a loop 230 is provided at each corner 235 of the bulk bag 215.

Figure 4:
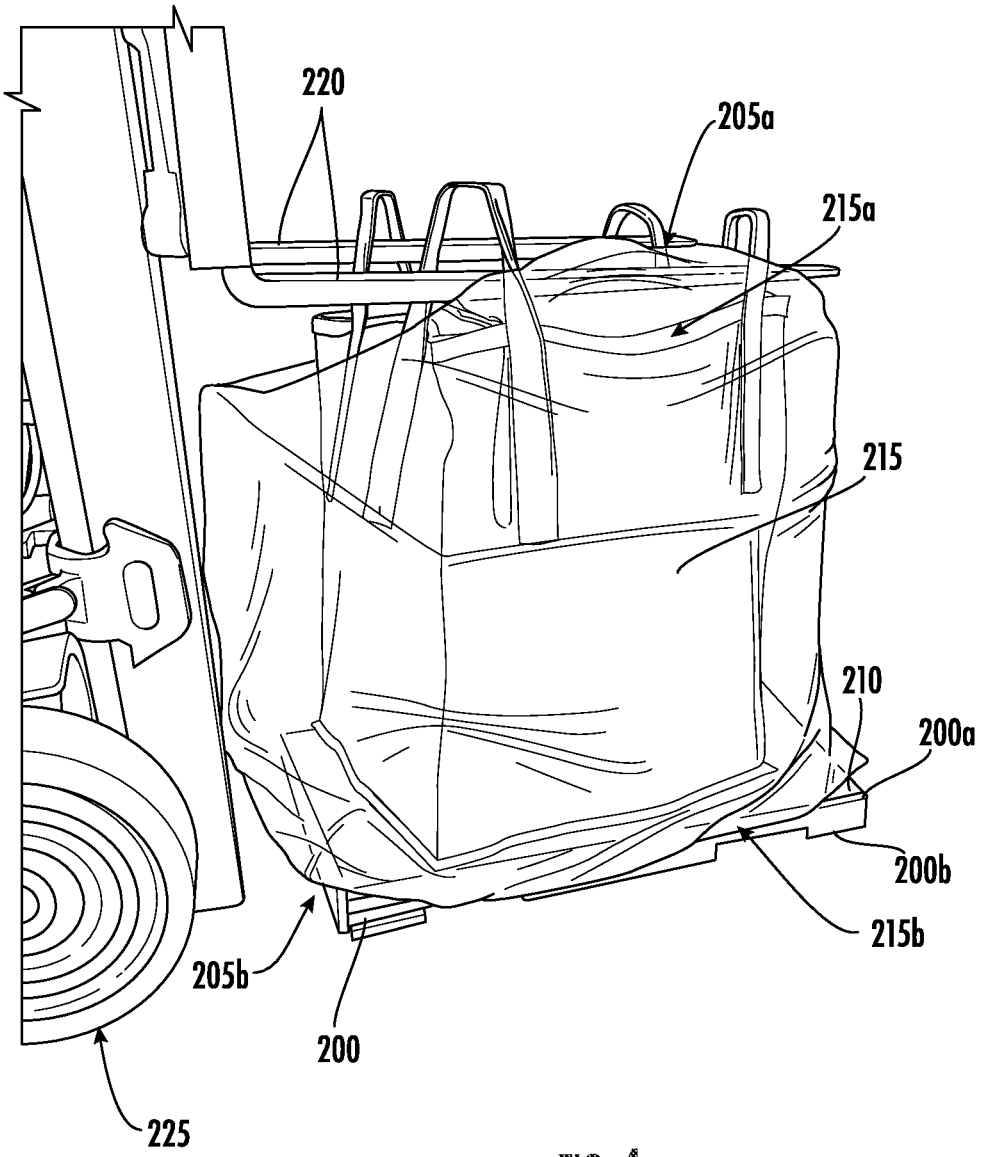
FIG. 4 depicts a bulk bag positioned inside an outer bag and on the pallet, according to an exemplary embodiment.
Figure 5:
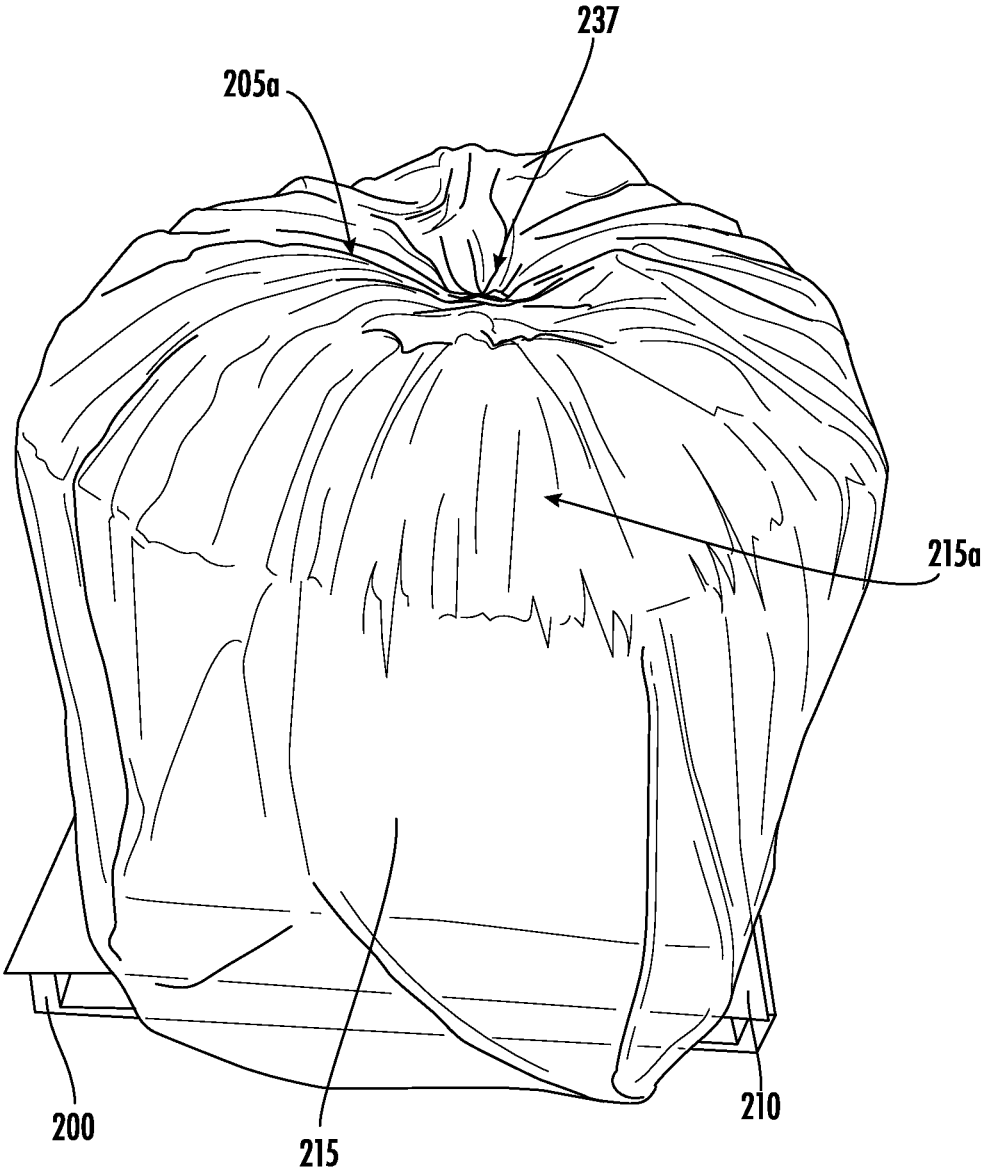
FIG. 5 depicts the outer bag enclosing the bulk bag, according to an exemplary embodiment.
Figure 6:
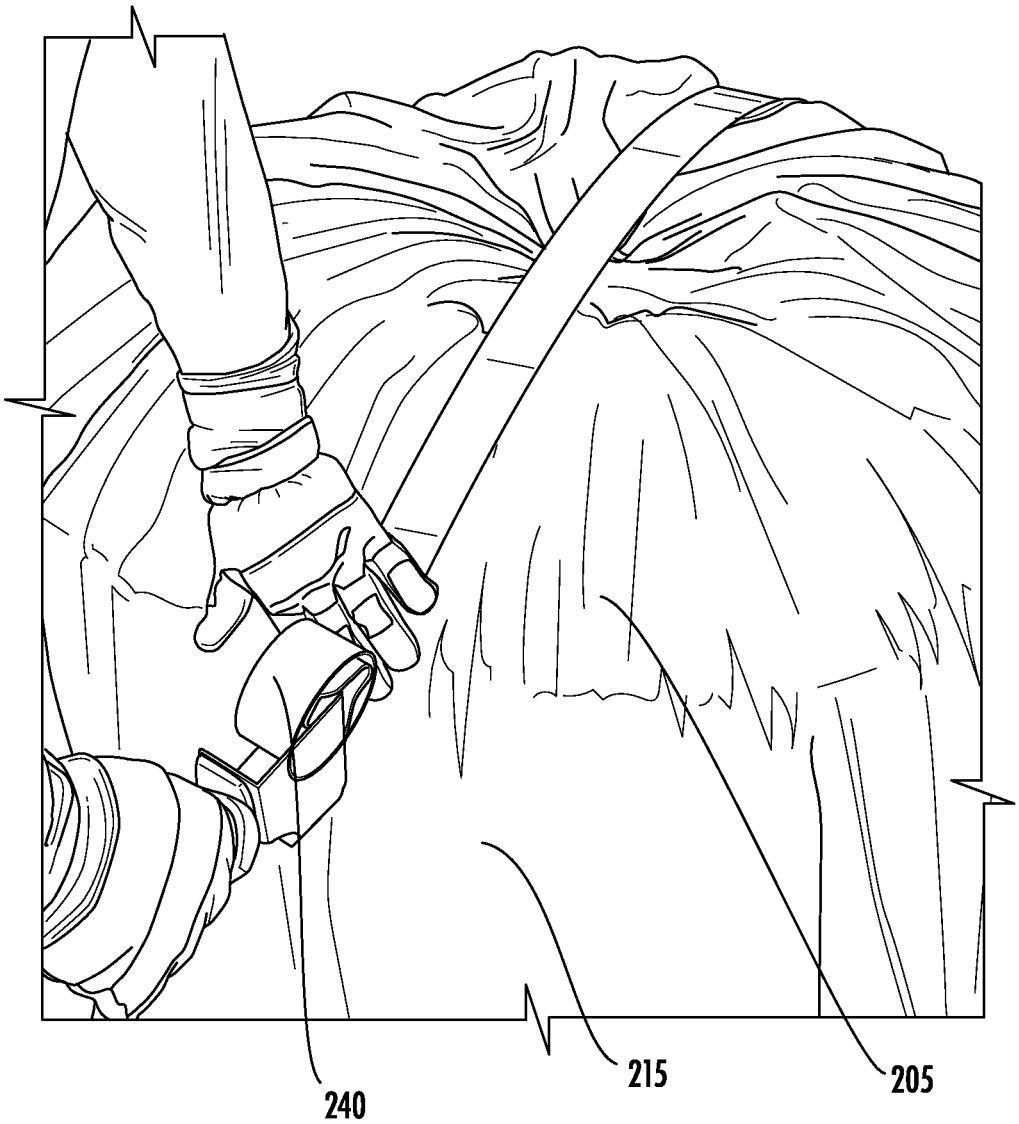
FIG. 6 depicts the outer bag being secured closed around the bulk bag, according to an exemplary embodiment.

As shown in FIG. 4, the bulk bag 215 has been placed inside the outer bag 205, and the bulk bag 215 has been positioned on the pallet 200. As can be seen in FIG. 4, the outer bag 205 has a first open end 205*a* and a first closed end 205*b*, and the bulk bag 215 has a top end 215*a* and a bottom end 215*b*. The bottom end 215*b* of the bulk bag 215 is inserted into the outer bag 205 through the first open end 205*a*. When supported by the pallet 200, the first closed end 205*a* of the outer bag 205 is located between bottom end 215*b* of the bulk bag 215 and the first side 200*a* of the pallet 200. The first open end 205*a* is brought up past the top end 215*a* of the bulk bag 215. The excess portion of the first open end 205*a* that extends past the top end 215*a* of the bulk bag 215 is gathered together at gather point 237 to enclose the outer bag 205 around the entirety of the bulk bag 215. The gathered portion of the outer bag 205 is then twisted, cinched, or otherwise secured together as shown in FIG. 5. Further, as shown in FIG. 6, the excess portion of the outer bag 205 may be secured in place around the bulk bag 215 using packing tape 240.

By providing the outer bag 205 around the bulk bag 215, a first layer of protection against moisture is provided. As discussed, the outer bag 205 entirely encloses the bulk bag 215. The outer bag 205 can be made from a variety of suitable materials. In embodiments, the outer bag 205 is made from at least one polyolefin, such as low density polyethylene, linear low density polyethylene, and high density polyethylene, among others. Additionally, in embodiments, the outer bag 205 can have a thickness of from 0.2 mil to 10 mil. In other embodiments, the outer bag 205 has a thickness of from 1 mil to 6 mil, and in still other embodiments, the outer bag 205 has a thickness of from 2 mil to 4 mil.

Figure 3:
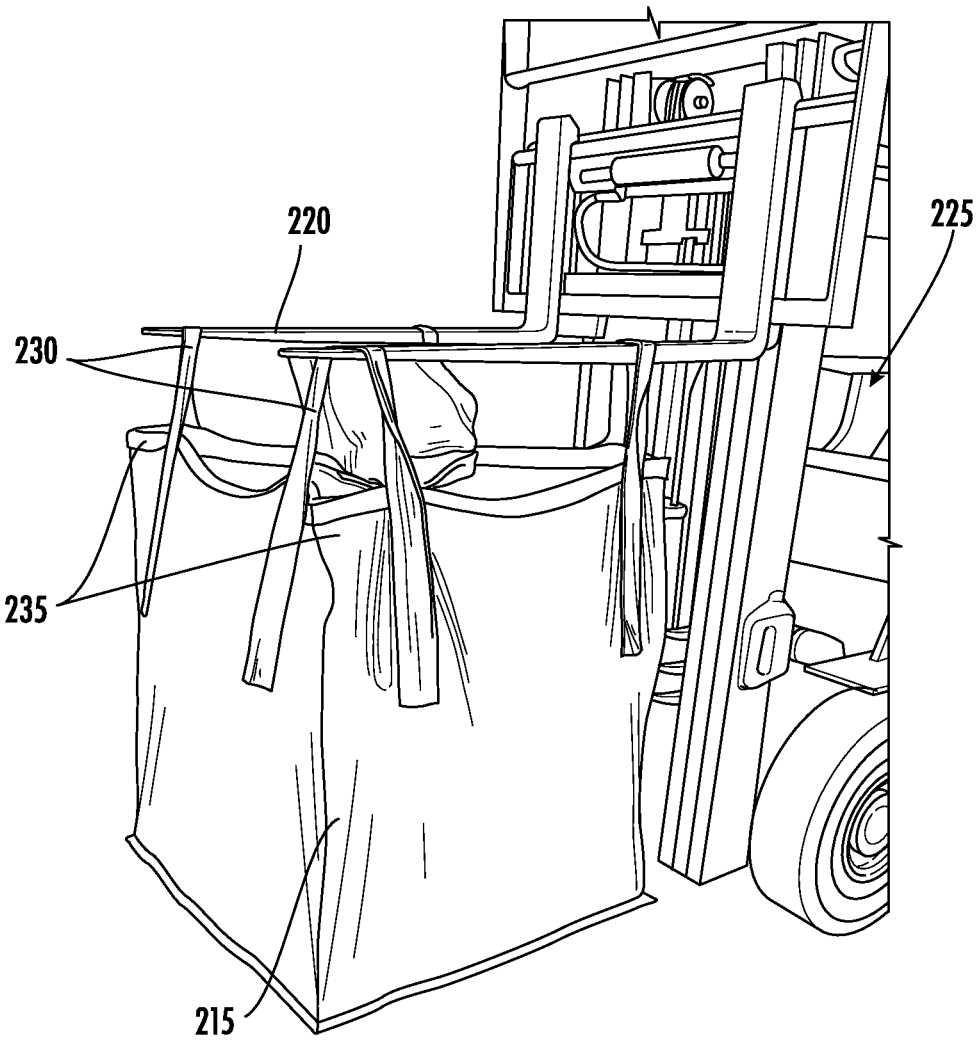
FIG. 3 depicts a bulk bag filled with a dry bulk material being lifted by a forklift, according to an exemplary embodiment.
Figure 7:
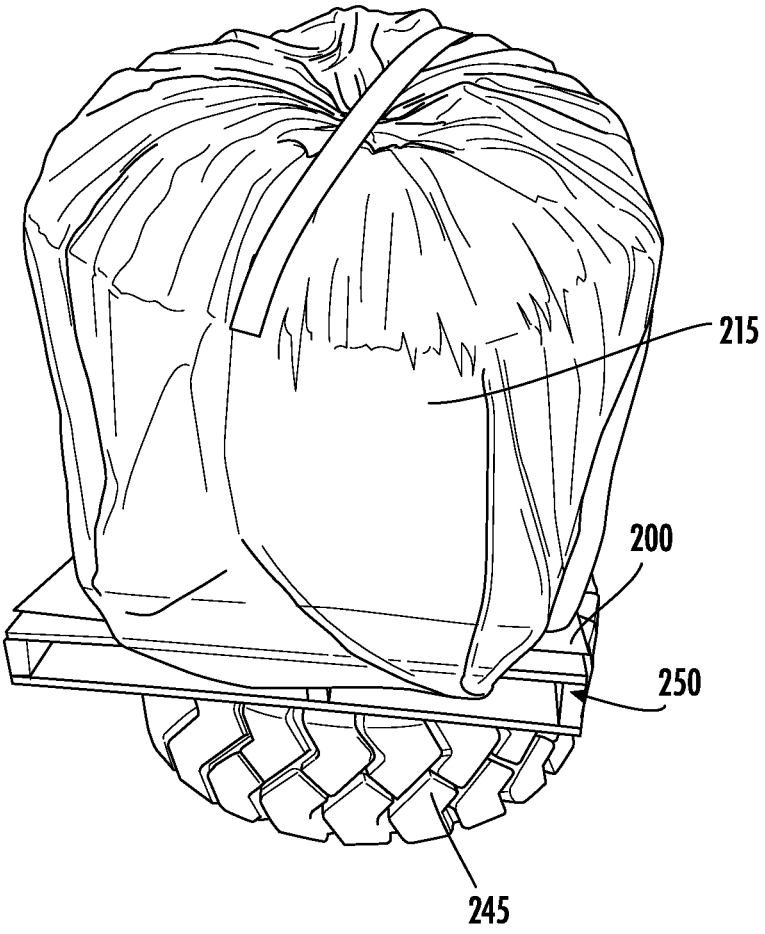
FIG. 7 depicts the bulk bag being supported on the pallet and elevated on a pedestal, according to an exemplary embodiment.

After enclosing the bulk bag 215 in the outer bag 205, the pallet 200 is placed on an elevated surface, which, as will be discussed more fully below, allows for the heatshrink bag to be shrunk around at least a portion of the bottom of the pallet. As can be seen in FIG. 7, the pallet 200 has been elevated on a tire 245. In embodiments, the elevated surface is selected such that at least a portion of the pallet 200 extends past the outer perimeter of the elevated surface. In FIG. 7, the elevated surface provided by the tire 245 is in the shape of a circle having a diameter that is less than at least a side length of the rectangular-shaped pallet 200. In this way, at least the corners 250 of the pallet 200 extend past the outer perimeter of the tire 245. In other embodiments, the elevated surface may be a lifting device, such as the forks 220 of a forklift 225 (as shown in FIG. 3), for example. That is, the forks 220 lift the pallet 200 to an elevated position.

Figure 8:
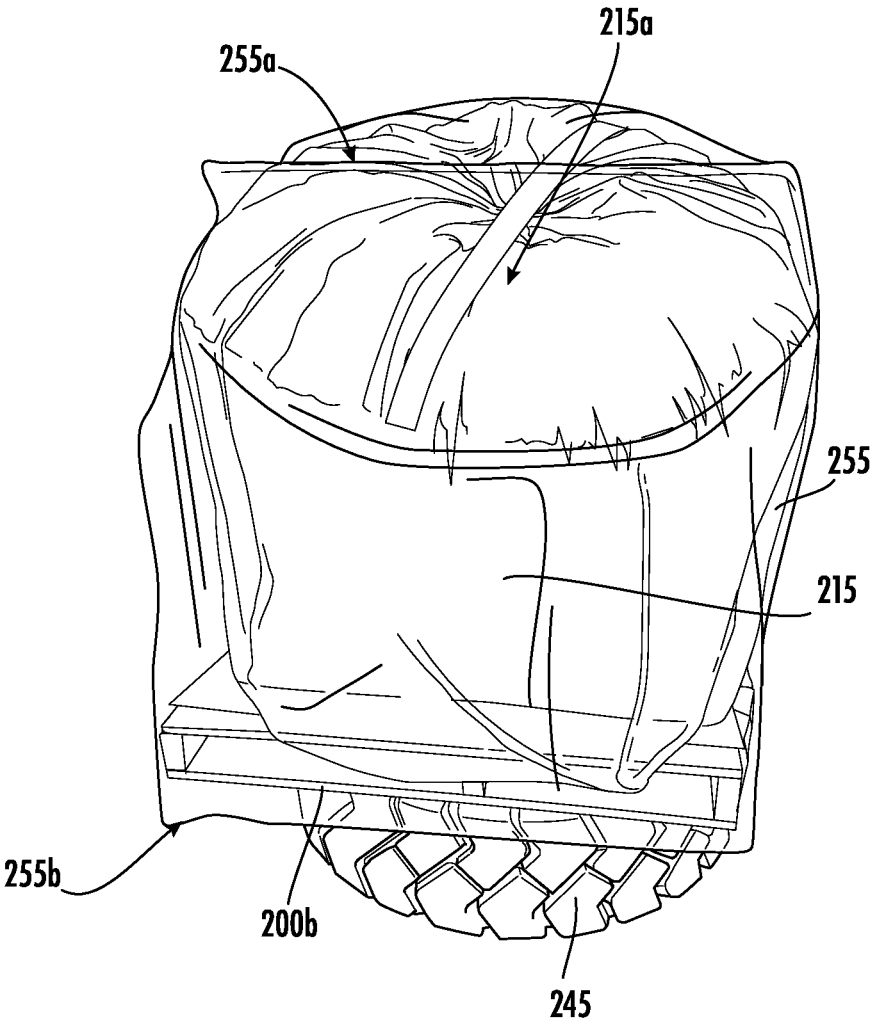
FIG. 8 depicts a heatshrink bag placed around the bulk bag, outer bag, and pallet, according to an exemplary embodiment.

As shown in FIG. 8, a heatshrink bag 255 is then placed over the bulk bag 215, the outer bag 205, and the pallet 200. The heatshrink bag 255 has a second open end 255*b* and a second closed end 255*a*. In relation to the bulk bag 215, the heatshrink bag 255 is positioned around the bulk bag 215 such that the second closed end 255*a* is proximate to the top end 215*a* of the bulk bag 215. The second open end 255*b* of the bulk bag 255 extends past the second side 200*b* of the pallet 200. As can be seen, using a tire 245 having a diameter smaller than a side length of the pallet 200 allows the heatshrink bag 255 to extend unimpeded below the second side 200*b* of the pallet 200.

Figure 9:
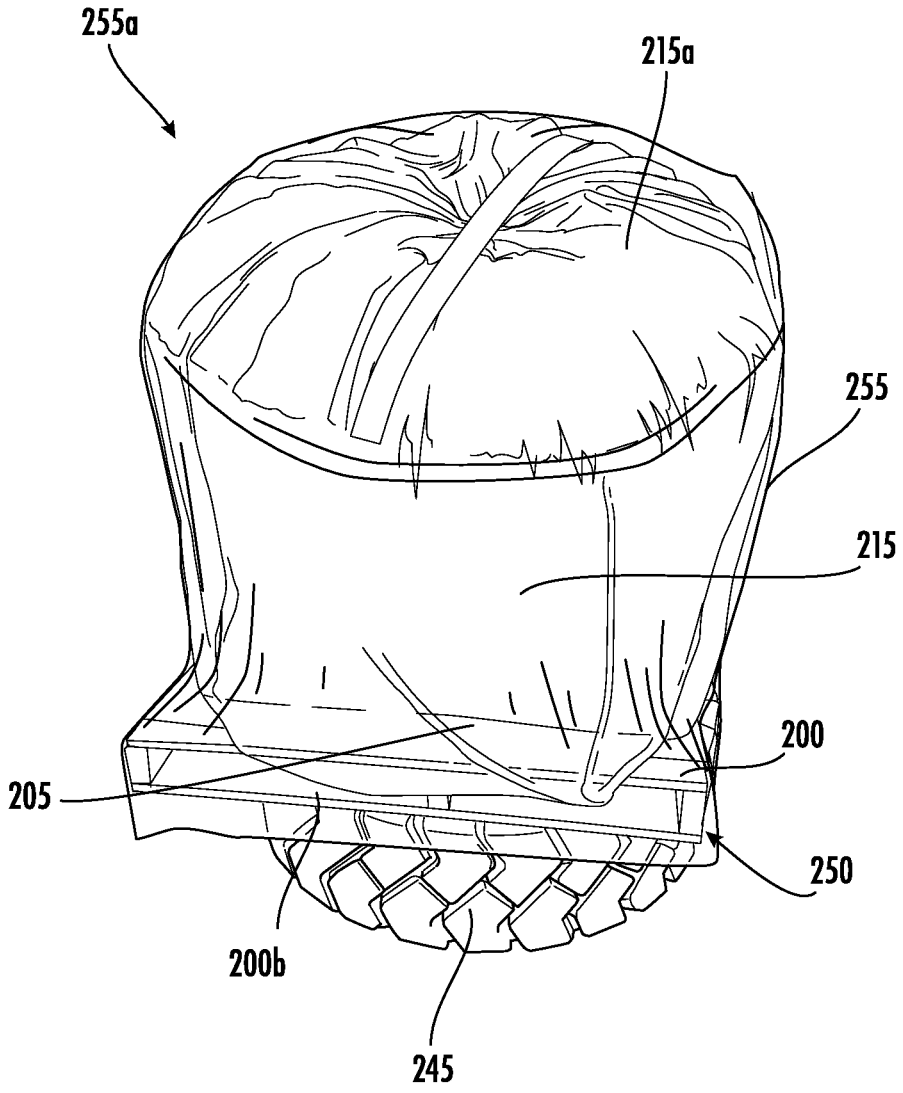
FIG. 9 depicts the heatshrink bag as shrunk around the bulk bag, outer bag, and pallet, according to an exemplary embodiment.

After positioning the heatshrink bag 255 over the bulk bag 215, the outer bag 205, and the pallet 200, heat is applied to the heatshrink bag 255 to cause the heatshrink bag 255 to shrink and constrict around the bulk bag 215, the outer bag 205, and at least a portion of the pallet 200. Heat can be applied to the heatshrink bag 255 in a variety of ways, include an electric or gas powered heat gun. The fully packaged bulk bag 215 is depicted in FIG. 9. As can be seen, the heatshrink bag 255 tightly engages the bulk bag 215, the outer bag 205, and at least a corner 250 of the pallet 200. In particular, the second open end 255*b* of the heatshrink bag 255 engages the second side 200*b* of the pallet, which ensures tight engagement between the heatshrink bag 255, the bulk bag, the first outer bag 205, and the pallet 200. In particular, tension is maintained in the heatshrink bag 255 such that the second closed end 255*a* pulls against the top end 215*a* of the bulk bag 215 and the second open end 255*b* pulls against the second side 200*b* of the pallet 200. In this way, excess material between the second open end 255*b* and the second closed end 255*a* does not bunch, fold, and/or gather, which might lead to water accumulation that could penetrate through the heatshrink bag 255 given the right conditions and enough time. By preventing bunching, folding, and/or gathering, water, such as rain water, will run off the surface without pooling.

The heatshrink bag 255 can be made from variety of materials that can be configured to exhibit the heatshrink property as discussed above. In embodiments, the heatshrink bag 255 is made from at least one polyolefin, such as polyethylene (low density, linear low density, or high density) or polypropylene, or from polyvinyl chloride (PVC). Further, in embodiments, the heatshrink bag 255 is a laminate material made from two or more layers of these materials. In embodiments, the heatshrink bag 255 has a thickness of from 0.25 mil to 12 mil. In other embodiments, the heatshrink bag 255 has a thickness of from 0.45 mil to 5 mil, and in still other embodiments, the heatshrink bag 255 has a thickness of from 1 mil to 4 mil.

An exemplary material that can be protected from moisture using the packaging system is a dry mix that includes cement and bed ash (and optionally, an aggregate). Such materials are described in U.S. Provisional Application Nos. 62/561,556, filed on Sep. 21, 2017, and 62/641,838, filed on Mar. 12, 2018, and U.S. Non-Provisional application Ser. No. 16/137,163, filed on Sep. 20, 2018, the contents of these three applications are incorporated in their entireties herein by reference. As described therein, the bed ash is produced via coal combustion in a fluidized bed reactor, particularly high sulfur coal that, in embodiments, has been post-treated with quicklime. The cement can be, e.g., a calcium sulfoaluminate (CSA) cement and/or an ASTM C150 type I, type II, type III portland cement. In embodiments, the bed ash and cement are mixed in a weight ratio of bed ash to cement of 3:1 to 5:1. In a particular embodiment, the cement makes up from 18 wt % to 20 wt % of the bed ash and cement mixture. Where provided, the aggregate may be a rock of the size 1.5"×3", i.e., the rock passes through a 3" mesh and is caught by a 1.5" mesh. In embodiments, the amount of bed ash and cement and the amount of aggregate are each about 50 wt %. Embodiments of the dry mix are usable for repairing roadways, especially in underground mines, and for repairing soil slips. In such contexts, the dry mix may be stored at a worksite until needed for repair of a roadway or of a soil slip, and keeping moisture out of the dry mix is desirable so that the dry mix is available for use as needed.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more than one component or element, and is not intended to be construed as meaning only one.

It will be apparent to those skilled in the art that various modifications and variations can be made without departing from the spirit or scope of the disclosed embodiments. Since modifications, combinations, sub-combinations and variations of the disclosed embodiments incorporating the spirit and substance of the embodiments may occur to persons skilled in the art, the disclosed embodiments should be construed to include everything within the scope of the appended claims and their equivalents.

What is claimed is:

1. A method of packaging a bulk bag containing a material, comprising the steps of:

inserting the bulk bag inside an outer bag;

positioning the bulk bag inside the outer bag on a pallet;

enclosing the bulk bag inside the outer bag;

placing the pallet on which the bulk bag and the outer bag are positioned on an elevated surface;

covering the bulk bag, the outer bag, and at least a portion of the pallet with a heatshrink bag;

applying heat to the heatshrink bag so as to cause shrinkage of the heatshrink bag around the bulk bag, the outer bag, and at least a portion of the pallet.

2. The method of claim 1, further comprising the step of placing a cardboard sheet between the outer bag and the pallet.

3. The method of claim 1, wherein the step of enclosing the bulk bag inside the outer bag further comprises:

gathering a first open end of the outer bag over a top end of the bulk bag;

cinching the outer bag at a location of the gathering; and securing an excess portion of the outer bag above the location of the gathering around the bulk bag using packing tape.

4. The method of claim 1, wherein at least a portion of the pallet extends past an outer perimeter of the elevated surface.

5. The method of claim 4, wherein the elevated surface has a circular shape with a diameter that is less than a side length of the pallet.

6. The method of claim 4, wherein, after the step of applying heat to the heatshrink bag, the heatshrink bag is at least partially in contact with an underside of the pallet.

7. The method of claim 6, wherein the heatshrink bag is at least partially in contact with a corner of the pallet on the underside of the pallet.

8. The method of claim 1, further comprising a step of filling the bulk bag with at least one of a cement, an ash, or a pozzolanic material prior to enclosing the bulk bag inside the outer bag.

* * * * *